US008452206B2

(12) United States Patent
Kawai

(10) Patent No.: US 8,452,206 B2
(45) Date of Patent: May 28, 2013

(54) IMAGE-FORMING APPARATUS WITH IMPROVED POSITIONING FOR MEDIUM CONVEYANCE

(75) Inventor: Jun Kawai, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 351 days.

(21) Appl. No.: 12/834,172

(22) Filed: Jul. 12, 2010

(65) Prior Publication Data

US 2011/0064458 A1 Mar. 17, 2011

(30) Foreign Application Priority Data

Sep. 11, 2009 (JP) ..... 2009-210311

(51) Int. Cl.
*G03G 15/00* (2006.01)

(52) U.S. Cl.
USPC ..... 399/110; 399/121

(58) Field of Classification Search
USPC ..... 399/110, 121
See application file for complete search history.

(56) References Cited

U.S. PATENT DOCUMENTS

2004/0175210 A1* 9/2004 Otaka ..... 399/318
2005/0281594 A1 12/2005 Kuma et al.

FOREIGN PATENT DOCUMENTS

JP A-10-142859 5/1998
JP A-2006-003735 1/2006
JP A-2007-183431 7/2007

* cited by examiner

*Primary Examiner* — Ryan Walsh
(74) *Attorney, Agent, or Firm* — Oliff & Berridge, PLC

(57) ABSTRACT

An image-forming apparatus includes: a housing; a first cover attached to the housing; a belt-shaped intermediate transfer body; a rotating member; a support member that contacts an inner surface of the intermediate transfer body at a position opposed to the rotating member to form an image transfer portion where an image is transferred from the intermediate transfer body onto a recording medium; a first supporting unit provided to the housing to support a first end of the support member, a positioning mechanism that determines a position of the first cover relative to the housing when the first cover is closed; and a second supporting unit provided to the first cover to support a second end of the support member, such that a pressure generated between the support member and the rotating member is increased when the first cover is closed than when the first cover is opened.

9 Claims, 8 Drawing Sheets

IMAGE-FORMING APPARATUS WITH IMPROVED POSITIONING FOR MEDIUM CONVEYANCE

CROSS-REFERENCE TO RELATED APPLICATIONS

This application is based on and claims priority under 35 U.S.C. 119 from Japanese Patent Application No. 2009-210311, which was filed on Sep. 11, 2009.

BACKGROUND

1. Technical Field

The present invention relates to an image-forming apparatus.

2. Related Art

Some image-forming apparatuses are provided with a mechanism for preventing a replacement component part from becoming misaligned when inserted improperly into the image-forming apparatus by a user or a serviceman, or for facilitating replacement of component parts.

SUMMARY

In one aspect of the present invention, there is provided an image-forming apparatus including: a housing; a first cover attached to the housing such that the first cover can be opened and closed; a belt-shaped intermediate transfer body that is rotated in the housing while being in contact with an image-holding member that holds an image, such that the image held by the image-holding member is transferred onto the intermediate transfer body, the intermediate transfer body being capable of being installed into and removed from the housing when the first cover is opened; a rotating member disposed in the housing at a position on a conveyance path of a recording medium to form an image transfer portion where an image, which has been transferred to the intermediate transfer body from the image-holding member, is transferred onto a recording medium that is conveyed in contact with the rotating member; a support member that is disposed at a position opposed to the rotating member and that contacts an inner surface of the intermediate transfer body to support the intermediate transfer body, the support member forming the image transfer portion in cooperation with the rotating member and being capable of being installed into and removed from the housing together with the intermediate transfer body when the first cover is opened; a first supporting unit provided to the housing to support a first end of the support member, a positioning mechanism that determines a position of the first cover relative to the housing when the first cover is closed; and a second supporting unit provided to the first cover to support a second end of the support member when the first cover is closed, such that a pressure generated between the support member and the rotating member is greater when the first cover is closed than when the first cover is opened.

BRIEF DESCRIPTION OF THE DRAWINGS

Exemplary embodiments of the present invention will now be described in detail with reference to the following figures, wherein.

DETAILED DESCRIPTION

1. Exemplary Embodiment

Figure 1:
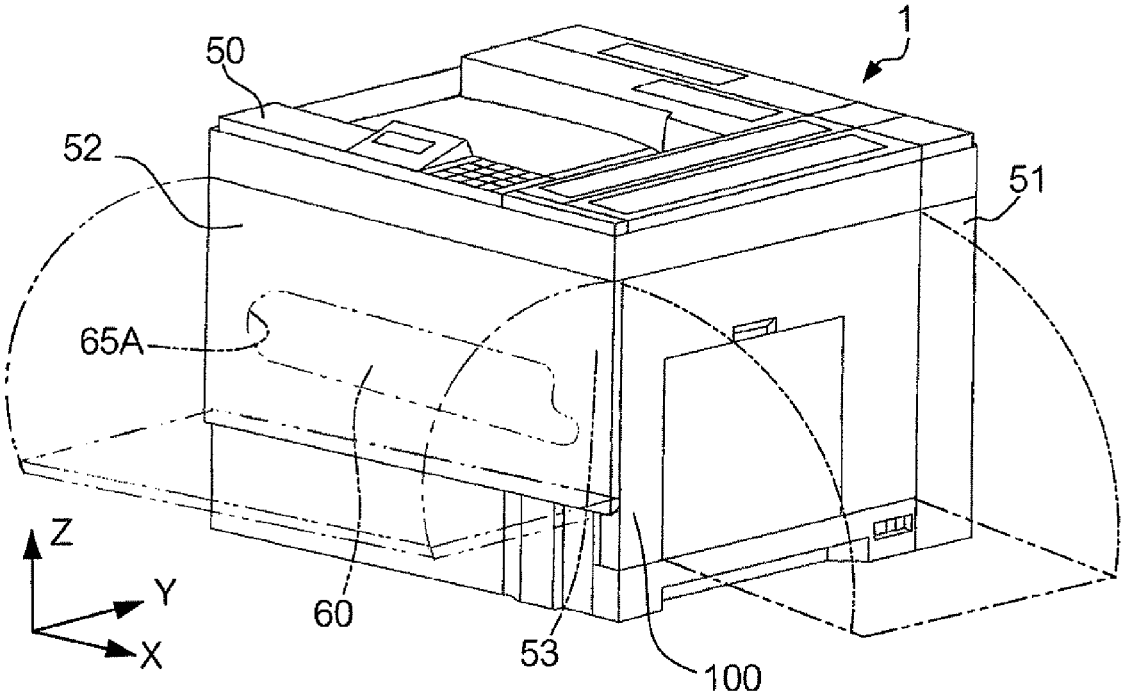
FIG. 1 is a perspective view showing an image-forming apparatus using a housing according to an exemplary embodiment of the present invention.
Figure 2:
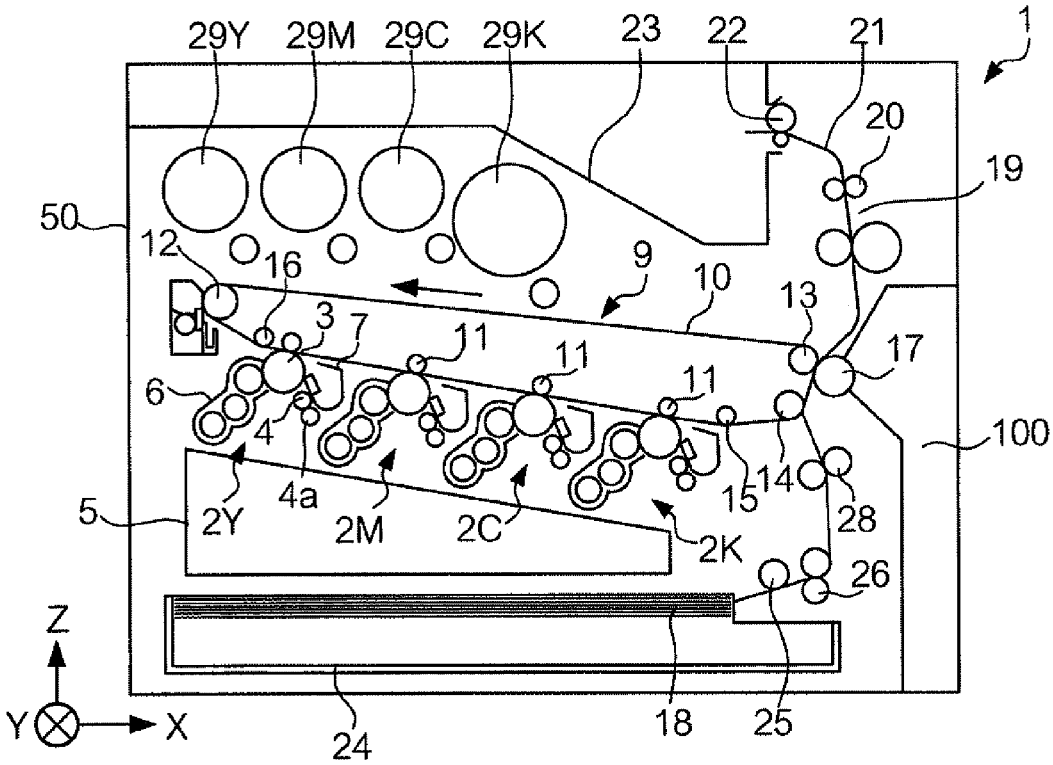
FIG. 2 is a schematic view showing a configuration of the image-forming apparatus.

An image-forming apparatus, such as a printer or a copy machine, has a housing that is provided on its front or lateral side with an openable cover for component maintenance, removal of jammed media, and so on. In the following, with such an image-forming apparatus being taken as an example, description will be made of an exemplary embodiment of the present invention. FIG. 1 is a perspective view of an exterior of an image-forming apparatus having a housing according to the exemplary embodiment, and FIG. 2 is a schematic representation of an interior configuration of a housing of the image-forming apparatus.

<Configuration of Image-Forming Apparatus>

As shown in FIG. 1, an outer shape of image-forming apparatus 1 is formed by box-shaped housing device 50, and outer cover 52 is provided on a front of housing 51, which serves as a base of housing device 50, such that outer cover 52 can be opened and closed. When outer cover 52 is opened, front frame 53, which is provided with inner cover 60 that can be opened and closed and serves as a first cover of opening 65A, is exposed to an outside. Further, on a right side of housing 51 there is provided an openable side cover 100.

In the following, description is made of image-forming apparatus 1 viewed from a perspective of a user from the front of the apparatus, wherein the horizontal direction is denoted as the X-axis direction, the front-back direction is denoted as the Y-axis direction, and the vertical direction is denoted as the Z-axis direction. It is to be noted that the denotations "left" and "right" are used from a perspective of the user.

Now, with reference to FIG. 2, explanation will be given of an example of an inner configuration and an operation of image-forming apparatus 1. Image-forming apparatus 1 is adapted to constitute a full-color printer of a tandem type, and contains an image-processing unit (not shown in the drawings) that performs image-processing on image data received from a device such as a scanner or a personal computer (not shown in the drawings), or received via a telephone line (not shown in the drawings), or the like. Inside image-forming apparatus 1 there are provided four image-forming units 2Y, 2M, 2C, 2K for yellow (Y), magenta (M), cyan (C), and black (K), respectively. These image-forming units 2Y, 2M, 2C, 2K are arranged such that they are spaced apart from one another in a generally horizontal direction and extend in parallel.

Vertical positions of image-forming units 2Y, 2M, 2C, 2K are lower respective to one another in the order stated. Accordingly, image-forming unit 2Y is positioned higher than image-forming unit 2K, and so on, whereby a plane along which image-forming units 2Y, 2M, 2C, 2K are arranged is caused to incline at a particular angle (e.g., 10 degrees) with respect to the horizontal direction. By this arrangement, a length in a horizontal direction can be reduced comparative to a case where image-forming units 2Y, 2M, 2C, 2K are arranged all at the same height along a horizontal plane.

Each of the four image-forming units 2Y, 2M, 2C, 2K has basically the same structure, and contains photosensitive drum 3 that is driven to rotate at a certain speed by a drive unit (not shown in the drawings) and that serves as an image-holding member, primary charging roll 4 that charges a surface of photosensitive drum 3, developer unit 6 that develops, with toner, an electrostatic latent image formed on photosensitive drum 3 as a result of image exposure performed by image exposure unit 5 (described later), and cleaning unit 7 that cleans the surface of photosensitive drum 3. Photosensitive drum 3 is constituted, for example, of an organic photosensitive member having a cylindrical shape with a diameter of 30 mm, and having an overcoat layer on its surface. Photosensitive drum 3 is rotated by a drive motor (not shown in the drawings). Charging roll 4 is, for example, a roll-shaped charger constituted of a core bar coated with a conductive layer made of a synthetic resin or rubber and having an adjusted electric resistance, and a charging bias is applied to the core bar of charging roll 4. Further, cleaning roll 4*a* for removing foreign matter such as toner adhering to a surface of charging unit 4 is arranged to contact the surface of charging roll 4.

In the following description, where it is not necessary to distinguish between image-forming units 2Y, 2M, 2C, 2K, the image-forming units will simply be referred to as image-forming unit(s) 2.

Below image-forming units 2Y, 2M, 2C, 2K, exposure unit 5 is provided. Exposure unit 5 has four semiconductor laser units (not shown in the drawings) for emitting laser beams modulated in accordance with image data. The four laser beams emitted from these semiconductor laser units are deflected by a polygon mirror for scanning, and are irradiated onto photosensitive drum 3 of each image-forming unit 2Y, 2M, 2C, 2K via optical elements such as a lens and a mirror (not shown in the drawings).

In this exemplary embodiment, exposure unit 5 extends along an underside of the four image-forming units 2Y, 2M, 2C, 2K, which are arranged in a plane inclined with respect to the horizontal direction. Thus, a length of a light path of the laser beam irradiated onto photosensitive drum 3 is the same for each of image-forming units 2Y, 2M, 2C, and 2K.

Image exposure unit 5, which is provided in common to each image-forming unit 2Y, 2M, 2C, 2K, receives image data of respective colors sequentially from the image-processing unit. The laser beam emitted from image exposure unit 5 in accordance with the image data is irradiated onto a surface of corresponding photosensitive drum 3 to form an electrostatic latent image thereon. The electrostatic latent images formed on photosensitive drums 3 are developed by developer units 6Y, 6M, 6C, 6K to form toner images of respective colors. The toner images of respective colors formed sequentially on photosensitive drums 3 of image-forming units 2Y, 2M, 2C, 2K are transferred one on top of another by primary transfer rolls 11 to intermediate transfer belt 10, which is arranged obliquely over the top of each image-forming unit 2Y, 2M, 2C, 2K, and serves as an intermediate transfer member.

Intermediate transfer belt 10 is an endless belt-shaped member tension-supported by multiple rolls. Specifically, intermediate transfer belt 10 is wound around tension roll 12, drive roll 13 (serving as a support member), backup roll 14, first idler roll 15, and second idler roll 16, such that intermediate transfer belt 10 is circulatingly moved in a direction indicated by an arrow in FIG. 2 by tension roll 12, which is rotated by a dedicated drive motor (not shown in the drawings) capable of maintaining a constant rotation speed. Intermediate transfer belt 10 has an upper moving section and a lower moving section, and the lower moving section is inclined with respect to the horizontal direction, with a downstream end of the lower moving section positioned lower than an upstream end of the same with respect to the direction of movement of the lower moving section. As intermediate transfer belt 10, a flexible film made of a synthetic resin, such as polyimide, may be used, where the ends of the synthetic resin film are connected by means of welding or the like to form an endless belt member. Intermediate transfer belt 10 is arranged such that the lower moving section is in contact with photosensitive drums 3Y, 3M, 3C, 3K of image-forming units 2Y, 2M, 2C, 2K.

It is to be noted that intermediate transfer belt 10, primary transfer rolls 11, tension roll 12, drive roll 13, backup roll 14, first idler roll 15, second idler roll 16, etc., are integrated into a single unit referred to as intermediate transfer unit 9.

Recording sheets 18, having a prescribed size and being made of a prescribed material, and serving as recording media, are contained in sheet container 24 disposed inside image-forming apparatus 1, and are conveyed from sheet container 24 along conveyance path 21 formed by pairs of rollers. In this conveyance path 21, recording sheets 18 in sheet container 24 are conveyed, one sheet at a time, by means of sheet supply roll 25 and a pair of rolls 26 for sheet separation and conveyance to registration roll 28, and are temporarily stopped there. Then, recording sheet 18 is further conveyed to a secondary transfer position of intermediate transfer belt 10 by registration roll 28, which is rotated at a predetermined timing. Recording sheet 18, on which the toner images of respective colors have been transferred at the secondary transfer position, is applied with heat and pressure by fixing unit 19 to fix the toner images. Thereafter, recording sheet 18 passes through exit roll 20 of fixing unit 19, and is discharged by discharge roll 22 onto sheet-receiving tray 23 provided at an upper portion of image-forming apparatus 1.

At a position on conveyance path 21 that is opposed to drive roll 13 across intermediate transfer belt 10 is provided secondary transfer roll 17, which is constituted of a rotating member and is urged against intermediate transfer belt 10. When recording sheet 18 moves between secondary transfer roll 17 and intermediate transfer belt 10, secondary transfer roll 17 presses recording sheet 18 against intermediate transfer belt 10, whereby the toner images of yellow (Y), magenta (M), cyan (C), and black (K), which have been overlappingly transferred onto intermediate transfer belt 10, are transferred onto recording sheet 18 owing to pressure and electrostatic force. The position at which secondary transfer roll 17 and drive roll 13 are opposed to each other across intermediate transfer belt 10 is the above-mentioned secondary transfer position.

Arranged between sheet-receiving tray 23 and intermediate transfer belt 10 are toner cartridges 29Y, 29M, 29C, 29K. Toner cartridges 29Y, 29M, 29C, and 29K supply toner to developer units 6Y, 6M, 6C, and 6K, respectively. Toner cartridge 29K containing toner of black (K) is larger than the toner cartridges of the other colors because black toner is used more frequently than any other toner.

<Configuration of Housing Device>

Next, with reference to FIGS. 1 and 3-5, explanation will be made of a configuration of housing 51 that defines an outer shape of image-forming apparatus 1.

Figure 3:
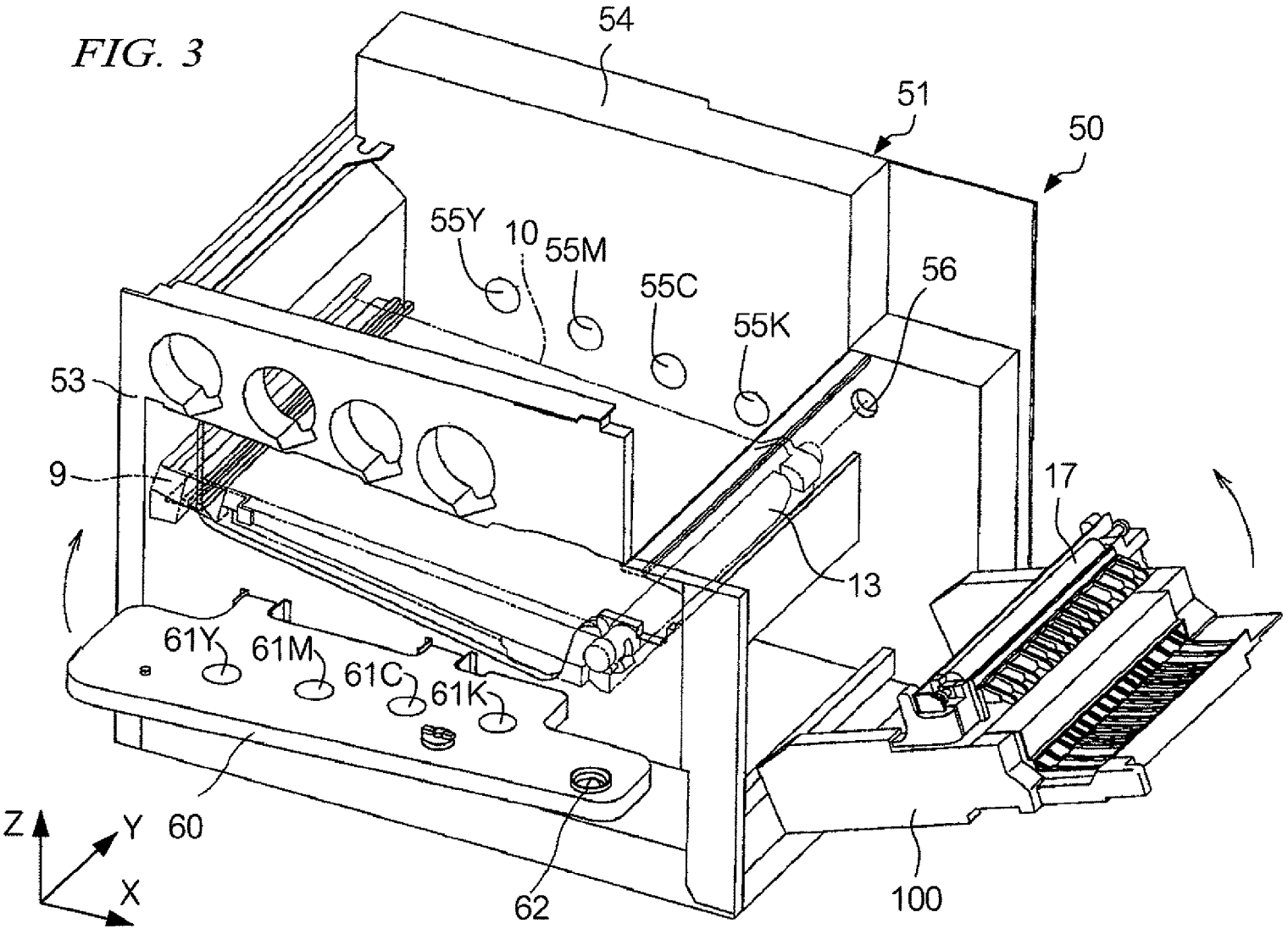
FIG. 3 is a perspective view showing a configuration of the housing.
Figure 4:
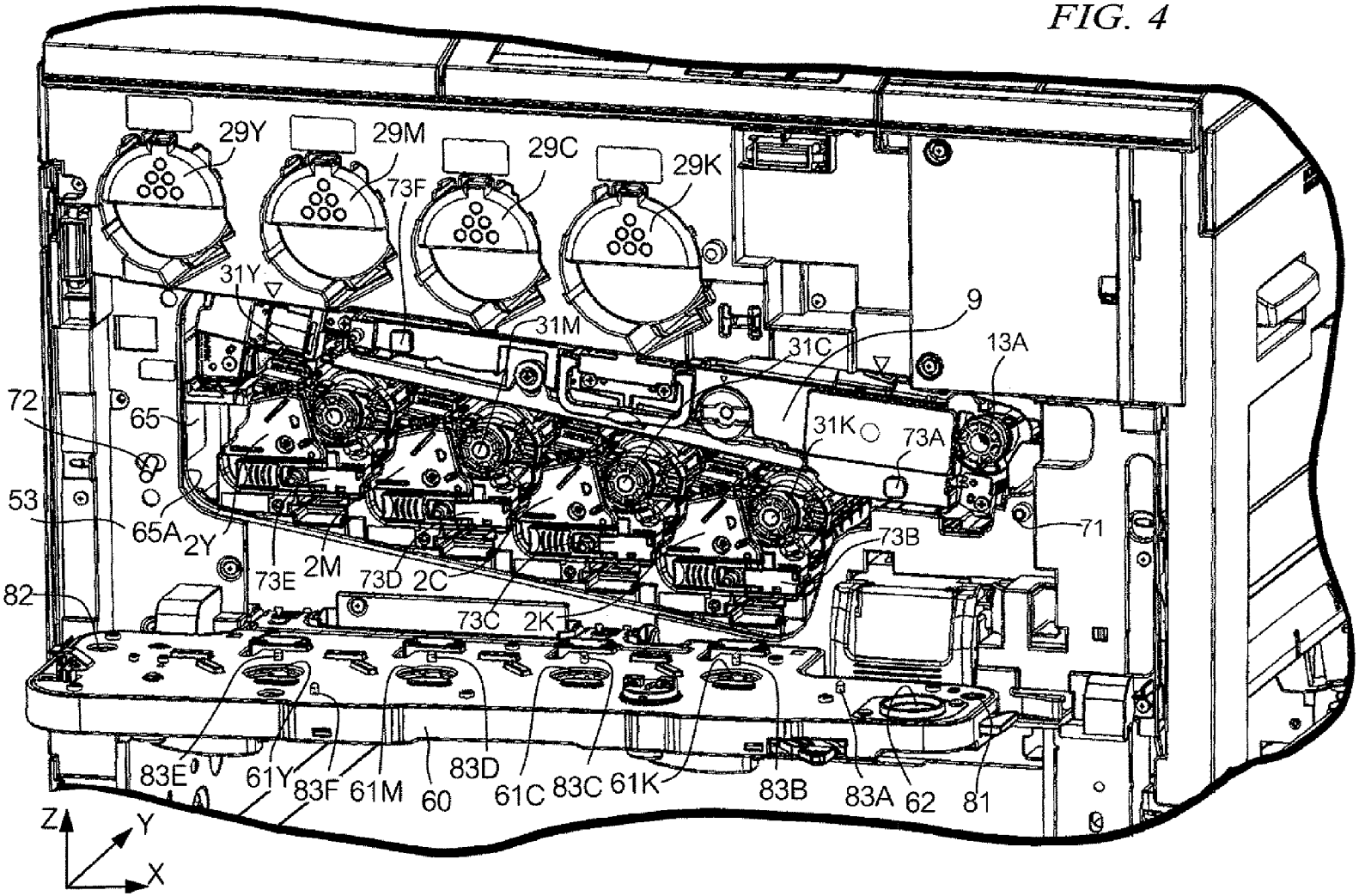
FIG. 4 is a perspective view showing a state where an outer cover and an inner cover (first cover) are opened.
Figure 5:
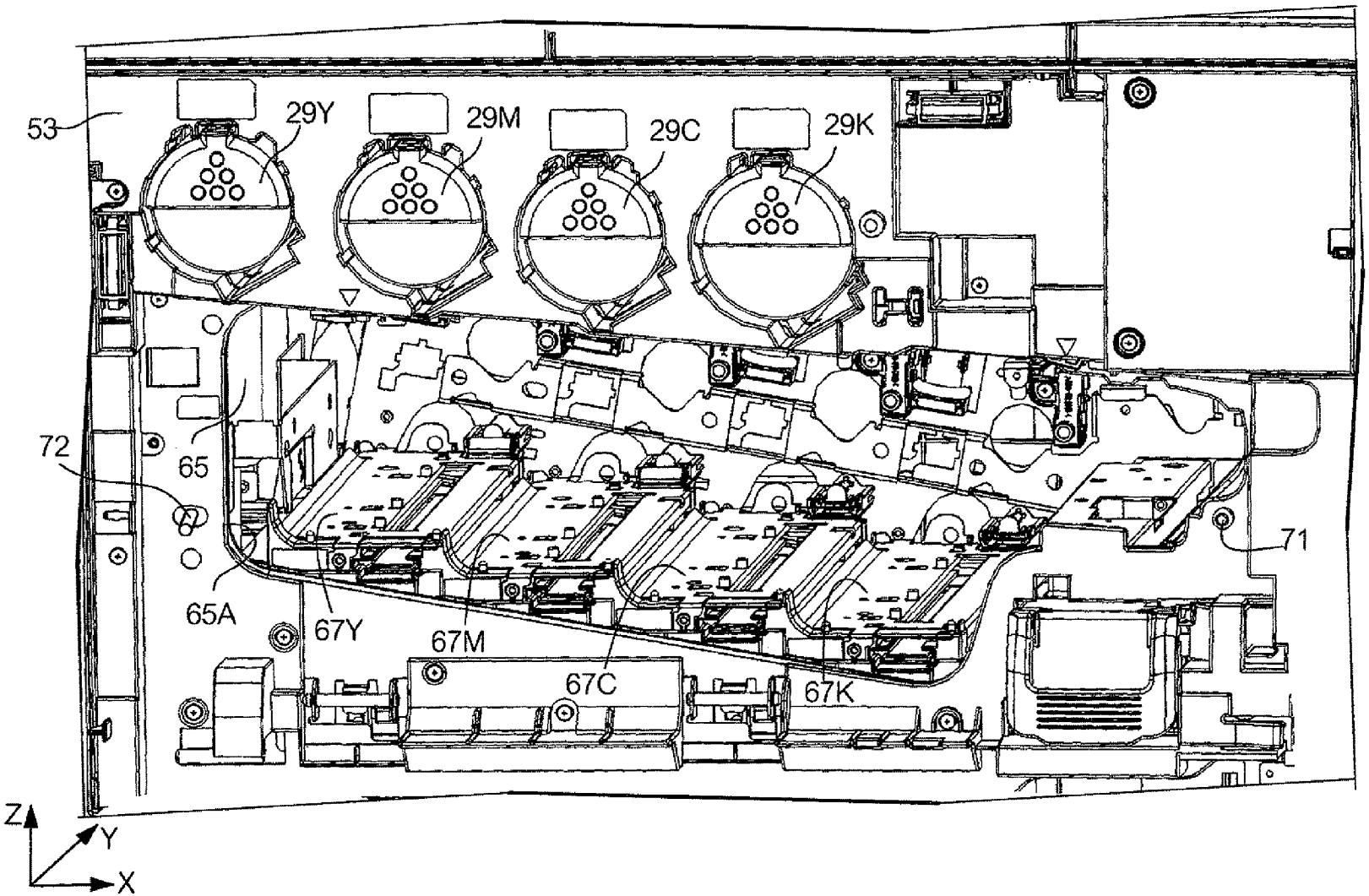
FIG. 5 is a perspective view showing a state of the housing where an intermediate transfer unit and image-forming units are removed from the state shown in FIG. 4.

FIG. 3 is a schematic view showing a configuration of housing 51, FIG. 4 is a perspective view showing a state where the outer cover and the inner cover are opened, and FIG. 5 is a perspective view showing housing 51 after the intermediate transfer unit and the image-forming units are removed therefrom.

As shown in FIG. 1, when outer cover 52 on the front of housing 51 is opened, front frame 53 is exposed. Toner cartridges 29Y, 29M, 29C, and 29K, intermediate transfer unit 9, etc. are detachably attached to front frame 53. Front frame 53 is also provided with inner cover 60 that can be opened and closed and serves as a first cover.

FIG. 3 shows a state where exterior members covering housing 51 have been removed. On a right side of housing 51 is provided a side cover 100 that can be opened and closed and serves as a second cover. Second transfer roll 17 is provided on an inner side of side cover 100 such that when side cover 100 is closed, second transfer roll 17 is elastically pressed against drive roll 13 via intermediate transfer belt 10 therebetween, to thereby generate a nip pressure. When side cover 100 is opened, conveyance path 21 near side cover 100 is exposed to allow removal of recording sheet 18 jammed in conveyance path 21.

Back frame 54 is disposed on a back side of housing 51 so as to be opposed to front frame 53. Between front frame 53 and back frame 54 is defined containment space 65 in which intermediate transfer unit 9, image-forming units 2, toner cartridges 29, etc. are detachably arranged.

As shown in FIG. 3, in a lower part of an inner side of back frame 54 of housing 51 are formed four shaft support holes 55Y, 55M, 55C, and 55K for supporting ends (first ends) of rotation shafts of respective photosensitive drums 3, and first roll support hole 56 for supporting an end (first end) of drive roll 13 of intermediate transfer unit 9. The inner side of back frame 54 provided with first roll support hole 56 serves as a first supporting unit. In a state where the first ends of photosensitive drums 3Y, 3M, 3C, 3K, and drive roll 13 are supported by back frame 54 in a cantilever manner, the position or attitude of these component parts is unstable. In other words, mere insertion of image-forming units 2 and intermediate transfer unit 9 is not sufficient to position photosensitive drums 3Y, 3M, 3C, 3K and drive roll 13 at their normal positions. Consequently, in such a state, a pressure generated at a nip portion defined between driver roll 13 and secondary transfer roll 17 when side cover 100 is closed may not reach a pressure necessary for performing secondary transfer of an image.

Figure 6:
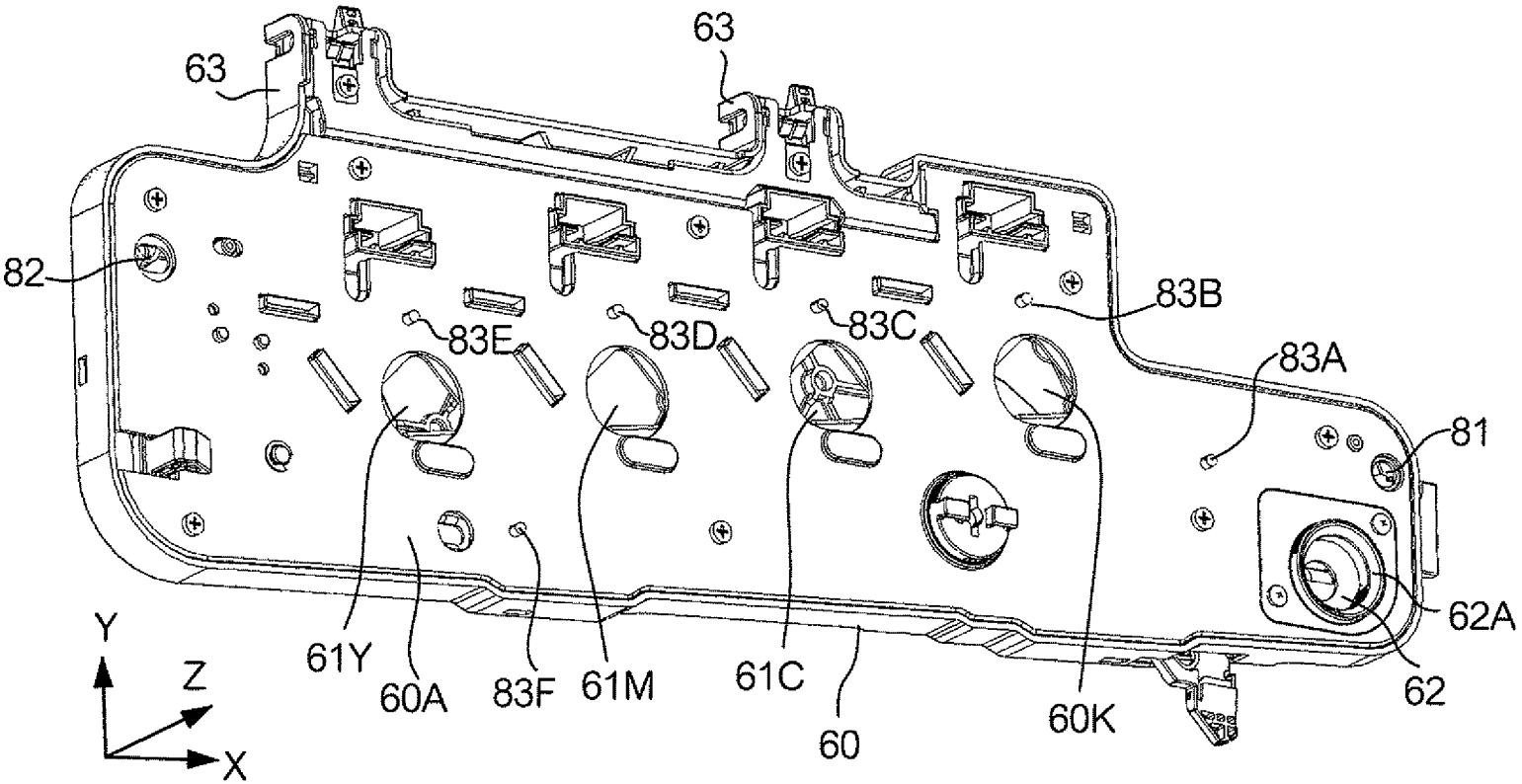
FIG. 6 is a perspective view of the inner cover as viewed form an inner side.

As shown in FIGS. 3-6, formed on inner side 60A of inner cover 60 are four shaft support holes 61Y, 61M, 61C, and 61K for supporting other ends (second ends) of the rotation shafts of photosensitive drums 3 included in image-forming units 2Y, 2M, 2C, and 2K, respectively, and second roll support hole 62 for supporting the other end (second end) of drive roll 13 of intermediate transfer unit 9, when inner cover 60 is closed. Inner side 60A provided with second roll support hole 62 serves as a second supporting unit. As shown in FIG. 6, second roll support hole 62 has inner circumferential surface 62A that is inclined such that a diameter of second roll support hole 62 becomes smaller from an entrance toward a bottom. The entrance of second roll support hole 62 is adapted to be larger than a range of movement of the second end of drive roll 13 that can be caused by closing of side cover 100 when only the first end of drive roll 13 is supported by back frame 54 in a cantilever manner.

Further, formed on a longer side of inner cover 60 is bracket 63 that constitutes a pin-coupling device for supporting inner cover 60 rotatably with respect to front frame 53.

It is to be noted here that the Y-axis direction is a direction of insertion/removal of image-forming units 2Y, 2M, 2C, and 2K, toner cartridges 29Y, 29M, 29C, and 29K, intermediate transfer unit 9, etc. with respect to housing 51.

As shown in FIG. 4, when inner cover 60 is opened, intermediate transfer unit 9 and image-forming units 2Y, 2M, 2C, 2K contained in containment space 65 are exposed through opening 65A provided to containment space 65. Further, as shown in FIG. 5, when image-forming units 2Y, 2M, 2C, 2K and intermediate transfer unit 9 are removed, containment space 65, which has opening 65A, and guide members 67Y, 67M, 67C, 67K provided in containment space 65 are exposed.

Containment space 65 and its opening 65A have a rectangular shape elongated generally in the horizontal direction, and a bottom side thereof is inclined such that a right portion is lower than a left portion, in conformity with an inclination of an upper side of image exposure unit 5. Guide members 67Y, 67M, 67C, and 67K for containment of image-forming units 2Y, 2M, 2C, and 2K, respectively, are provided at the bottom of containment space 65 so as to be positioned respectively lower in this order in a step-like manner. In a state where inner cover 60 is closed, photosensitive drums 3Y, 3M, 3C, and 3K of image-forming units 2Y, 2M, 2C, and 2K are supported so as to be apart from guide members 67Y, 67M, 67C, and 67K in the upward direction.

<Configuration of Positioning Mechanism, and Operation of Positioning Mechanism and First and Second Supporting Units>

Next, with additional reference to FIGS. 7-9, explanation will be made of a configuration of a positioning mechanism for determining a position of inner cover 60 relative to housing 51, and an operation of the positioning mechanism and first and second supporting units.

Figure 7:
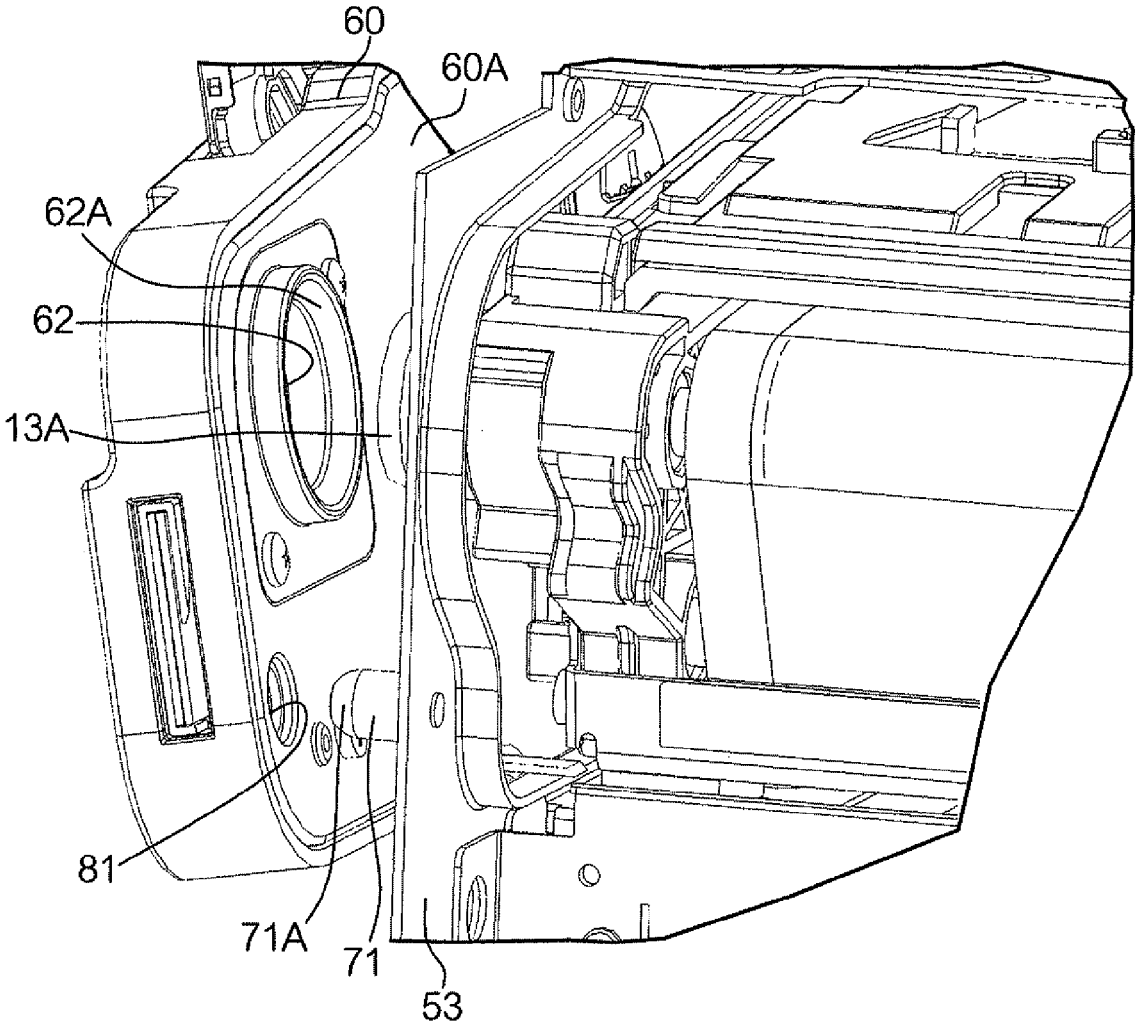
FIG. 7 is a perspective view showing an inner cover and a second end of a drive roll (support member) during closing of the inner cover.
Figure 8A:
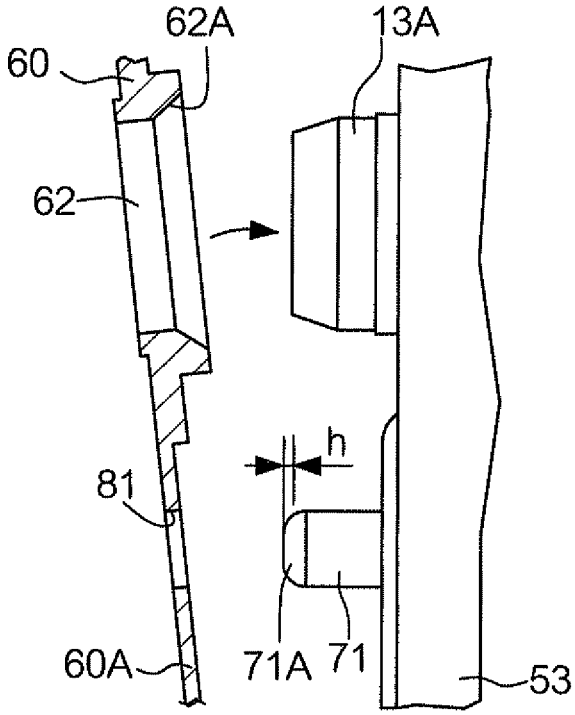
FIGS. 8A-8C are schematic diagrams showing a relationship between the inner cover and the second end of the drive roll during closing of the inner cover.
Figure 8B:
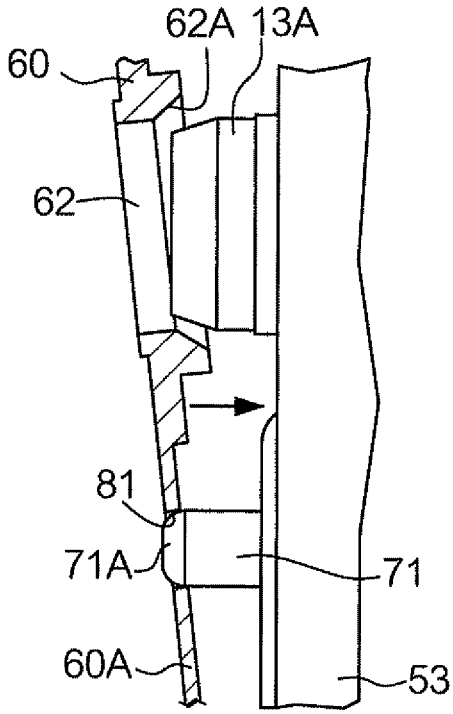
Figure 8C:
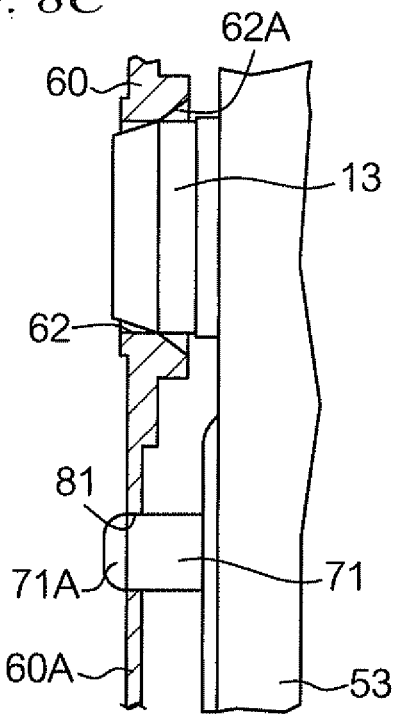
Figure 9A:
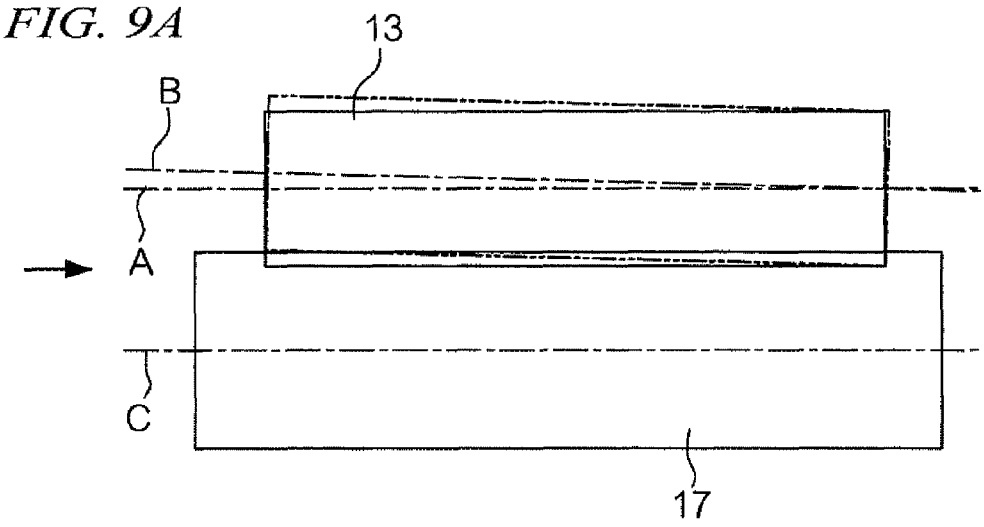
FIGS. 9A-9C are schematic diagrams showing a relationship between the drive roll and a secondary transfer roll (rotating member)
Figure 9B:
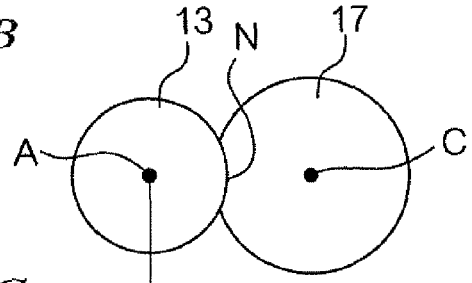
Figure 9C:
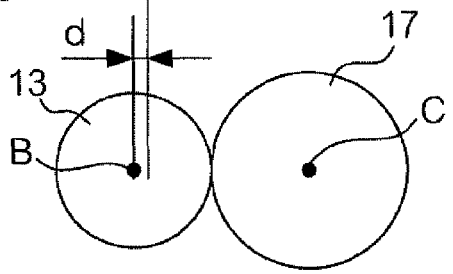

FIG. 7 is a perspective view showing the second end of drive roll 13 and inner side 60A of inner cover 60 when inner cover 60 is near a closed position, FIGS. 8A-8C are schematic diagrams showing various states of inner cover 60 during a closing operation, and FIGS. 9A-9C are schematic diagrams showing a relationship between drive roll 13 and secondary transfer roll 17.

First, a positioning mechanism will be explained. As shown in FIG. 4, drive roll 13 is provided with coupling 13A which is connected to a shaft (not shown in the drawings) of drive roll 13 at the second end of drive roll 13 (or an end in a direction opposite to the direction of insertion), and photosensitive drums 3Y, 3M, 3C, and 3K are respectively provided with couplings 31Y, 31M, 31C, and 31K, each of which is connected to a shaft (not shown in the drawings) of a corresponding one of photosensitive drums 3Y, 3M, 3C, and 3K at the second end of photosensitive drum 31Y, 31M, 31C, 31K (or an end in the direction opposite to the direction of insertion). Each of couplings 13A, 31Y, 31M, 31C, and 31K is formed to have a circular plate-like shape.

On a part of front frame 53 that overlaps inner cover 60, first protrusion 71, which is made of a metal and protrudes in the direction opposite to the direction of insertion, is formed at a position adjacent to coupling 13A, and second protrusion 72, which is made of a metal and protrudes in the direction opposite to the direction of insertion, is formed at a position opposite to first protrusion 71 across containment space 65.

The cross-section of each of first and second protrusions 71, 72 is circular, and an end portion of each of first and second protrusions 71, 72 is rounded to have a hemispherical shape so that a diameter (cross-section) decreases toward the end (end portion 71A of first protrusion 71 is shown in FIG. 7). On the other hand, on inner side 60A of inner cover 60, first recess 81 is formed at a position that is opposed to first protrusion 71 when inner cover 60 is closed, and second recess 82 is formed at a position that is opposed to second protrusion 72. Each of first and second recesses 81, 82 has a circular shape.

The corresponding protrusion and recess (i.e., first protrusion 71 and first recess 81, and second protrusion 72 and second recess 82) engage with each other when inner cover 60 is closed, and serve as a positioning mechanism that determines a position of inner cover 60 relative to front frame 53 (housing 51).

Further, as shown in FIGS. 4 and 6, inner side 60A of inner cover 60 is provided with protruding pushing pins 83A-83F, which are arranged in this order from right to left in these drawings. Pushing pin 83A is located at a position between second roll support hole 62 and shaft support hole 61K, pushing pins 83B-83E are located at positions between bracket 63 and shaft support holes 61K, 61C, 61M, 61Y, and pushing pin 83F is located at a position distant from shaft support hole 61Y and bracket 63.

On the other hand, a casing that defines an outer shape of intermediate transfer unit 9 is provided with pads 73A, 73F, with which pushing pins 83A, 83F come into contact when inner cover 60 is closed. Image-forming units 2K, 2C, 2M, 2Y are provided with pads 73B-73E, with which pushing pins 83B-83E come into contact when inner cover 60 is closed.

Pushing pins 83A-83F and pads 73A-73F serve as a pushing member, which pushes intermediate transfer unit 9 and image-forming units 2 toward an inside of containment space 65 when inner cover 60 is closed.

Explanation will now be made of an operation of the positioning mechanism and first and second supporting units, with reference to FIG. 7 and FIGS. 8A-8C. It is to be noted that first protrusion 71 and first recess 81 will be illustrated and explained in the following as an example of the positioning mechanism, and because second protrusion 72 and second recess 82 operate in a similar manner, explanation thereof will be omitted.

As shown in FIG. 8A, first protrusion 71 has a height greater than coupling 13A by a value "h," and is positioned closer to bracket 63 (fulcrum) of inner cover 60 than coupling 13A, and thus, in a closing operation of inner cover 60, end portion 71A of first protrusion 71 comes into contact with first recess 81 before coupling 13A comes into contact with second roll support hole 62.

When inner cover 60 begins to be closed after image-forming units 2 and intermediate transfer unit 9 are inserted into containment space 65, end portion 71A of first protrusion 71 contacts an inner circumferential surface of first recess 81, as shown in FIG. 8B, whereby the position of inner cover 60 relative to front frame 53 is adjusted while the insertion of first protrusion 71 into first recess 81 proceeds. Since end portion 71A is rounded to have a hemispherical shape, insertion of first protrusion 71 into first recess 81 can be achieved smoothly. In this way, positioning of inner cover 60 relative to housing 51 is carried out.

At a point during insertion of first protrusion 71 into first recess 81, coupling 13A comes into contact with inclined surface 62A of second roll support hole 62. In this state, only the first end of drive roll 13 is supported in a cantilever manner as described in the foregoing, and thus, the position of coupling 13A is not fixed. Therefore, when closing of inner cover 60 is continued after an edge of coupling 13A comes into contact with inclined surface 62A of second roll support hole 62, coupling 13A (second end of drive roll 13) is moved along inclined surface 62A. When inner cover 60 is further moved to reach the closed position as shown in FIG. 8C, first protrusion 71 is inserted into recess 81 and coupling 13A is inserted into second roll support hole 62.

Because first protrusion 71 and first recess 81 (positioning mechanism) are provided at a position adjacent to coupling 13A and second roll support hole 62, coupling 13A can be inserted into second roll support hole 62 more easily compared to a case where first protrusion 71 and first recess 81 are absent. That is, without the positioning performed using first protrusion 71 and first recess 81, inner cover 60 may move within a range of assembly error, and this may result in failure of coupling 13A to come into contact with inclined surface 62A of second roll support hole 62, which in turn may prevent insertion of coupling 13A into second roll support hole 62. However, with the positioning of inner cover 60 performed using first protrusion 71 and first recess 81, any assembly error of inner cover 60 can be rectified, whereby the problem is solved.

Next, with reference to FIGS. 9A-9C, explanation will be made of an operation for closing inner cover 60.

FIG. 9A shows a relationship between drive roll 13 and secondary transfer roll 17, in which axis line A of drive roll 13 corresponds to a case where inner cover 60 and side cover 100 are closed and drive roll 13 is located at a normal position (a position where a pressure generated between drive roll 13 and secondary transfer roll 17 is set at a pressure necessary for performing the secondary transfer), while axis line B of drive roll 13 corresponds to a case where only side cover 100 is closed and drive roll 13 is displaced from the normal position. FIGS. 9B and 9C are diagrams showing drive roll 13 and secondary transfer roll 17 as viewed from the left side in FIG. 9A. FIG. 9B shows the relationship between drive roll 13 and secondary transfer roll 17 when drive roll 13 is at the normal position as indicated by axis line A, and FIG. 9C shows the relationship between drive roll 13 and secondary transfer roll 17 when drive roll 13 is displaced from the normal position as indicated by axis line B. It is to be noted that in FIGS. 9A-9C, intermediate transfer belt 10 between drive roll 13 and secondary transfer roll 17 is omitted to show clearly the relationship between drive roll 13 and secondary transfer roll 17.

When inner cover 60 and side cover 100 are closed and drive roll 13 is located at the normal position, nip portion N is formed where drive roll 13 and secondary transfer roll 17 are in close contact with each other due to elastic deformation of secondary transfer roll 17, as shown in FIG. 9B, and a nip pressure is generated at nip portion N.

When side cover 100 is closed with inner cover 60 being kept open, a pushing force (nip pressure) is applied from secondary transfer roll 17 to drive roll 13, whose second end is not supported. As a result, the second end of drive roll 13 moves inwardly, so that its central axis shifts from axis line A by distance "d" to axis line B.

In a case where the positioning mechanism is absent, when inner cover 60, which may move within a range of assembly error, is closed in this state, coupling 13A of drive roll 13 may fail to engage second roll support hole 62, and thus the closing operation of inner cover 60 can be difficult. However, in the exemplary embodiment, since the positioning mechanism is provided adjacent drive roll 13 to perform positioning of inner cover 60 relative to housing 51 and thereby to correct an assembly error of inner cover 60, it is ensured that coupling 13A comes to engage inclined surface 62A of second roll support hole 62. In this way, even when drive roll 13 is at a position indicated by axis line B, closing of inner cover 60 causes the axis of drive roll 13 to move to align with axis line A, whereby drive roll 13 is pressed against secondary transfer roll 17 to form nip portion N.

That is, in a case where inner cover 60 is closed after side cover 100 is closed, as inner cover 60 approaches the closed position, the second end of drive roll 13, opposite to the first end, which has been inserted into first roll support hole 56, is inserted into second roll support hole 62 whereby drive roll 13 is moved to the normal position, and thus, a pressure generated at a nip portion (close contact portion) formed between drive roll 13 and secondary transfer roll 17 is set at a pressure necessary for performing the secondary transfer.

On the other hand, when side cover 100 is open, no pushing force from secondary transfer roll 17 acts upon drive roll 13, and thus, the axis of drive roll 13 of intermediate transfer unit 9 contained in containment space 65 does not move to a position indicated by axis line B in FIGS. 9A and 9C. Thus, when inner cover 60 is closed, coupling 13A of drive roll 13 is inserted into second roll support hole 62 easily, and drive roll 13 is supported at the normal position. Thereafter, when side cover 100 is closed, secondary transfer roll 17 is pressed against drive roll 13 to form nip portion N.

When intermediate transfer unit 9 is removed from housing 51, inner cover 60 and side cover 100 are opened, and thus, there is no component part contacting intermediate transfer belt 100, whereby intermediate transfer unit 9 can be drawn out of housing 51 without causing damage to intermediate transfer belt 10.

2. Modified Embodiments

The foregoing exemplary embodiment may be modified as described below.

<2-1>

Figure 10A:
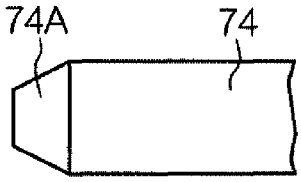
FIGS. 10A and 10B are schematic diagrams each showing a modified embodiment of a positioning mechanism.
Figure 10B:
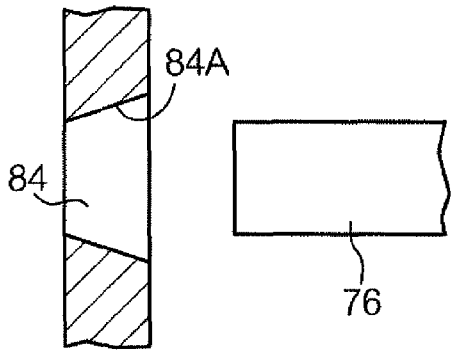

In the exemplary embodiment, end portion 71A of first protrusion 71 has a hemispherical shape, but the present invention is not limited to such an example, and the end portion may have various shapes such as those shown in FIGS. 10A and 10B.

Protrusion 74 shown in FIG. 10A has end portion 74A having a shape of a truncated cone having a diameter (cross-section) that reduces toward an end. Protrusion 76 and recess 84 shown in FIG. 10B are adapted such that protrusion 76 has a cylindrical shape having an angular edge as viewed from a side, and recess 84 has inclined circumferential surface 84A such that the diameter of recess 84 reduces from an opening toward a bottom.

In these modified embodiments also, insertion of the protrusion into the recess can be performed easily. Any other shapes of the protrusion and recess that facilitate insertion may be adopted.

Also, in the foregoing exemplary embodiment, the positioning mechanism includes protrusions provided to housing 51 and recesses provided to inner cover 60, but recesses may be provided to housing 51 and protrusions may be provided to inner cover 60, or housing 51/inner cover 60 may be provided with a mixture of protrusions and recesses. Also, the cross-section of the protrusion and the recess is not limited to a circular shape, and may be of any other shape, so long as the protrusion and the recess opposed thereto can engage with each other The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming apparatus comprising:

a housing;

a first cover attached to the housing such that the first cover can be opened and closed;

a belt-shaped intermediate transfer body that is rotated in the housing while being in contact with an image-holding member that holds an image, such that the image held by the image-holding member is transferred onto the intermediate transfer body, the intermediate transfer body being capable of being installed into and removed from the housing when the first cover is opened;

a rotating member disposed in the housing at a position on a conveyance path of a recording medium to form an image transfer portion where an image, which has been transferred to the intermediate transfer body from the image-holding member, is transferred onto a recording medium that is conveyed in contact with the rotating member;

a support member that is disposed at a position opposed to the rotating member and that contacts an inner surface of the intermediate transfer body to support the intermediate transfer body, the support member forming the image transfer portion in cooperation with the rotating member and being capable of being installed into and removed from the housing together with the intermediate transfer body when the first cover is opened;

a first supporting unit provided to the housing to support a first end of the support member, a positioning mechanism that determines a position of the first cover relative to the housing when the first cover is closed; and a second supporting unit provided to the first cover to support a second end of the support member when the first cover is closed, such that a pressure generated between the support member and the rotating member is greater when the first cover is closed than when the first cover is opened.

2. The image-forming apparatus according to claim 1, further comprising a second cover attached to the housing such that the second cover can be opened and closed, wherein the rotating member is provided on a side of the second cover facing toward an inside of the housing, such that the rotating member is pressed against the support member via the intermediate transfer body when each of the first cover and the second cover is closed, and is moved to be apart from the intermediate transfer body when the second cover is opened while the first cover is kept closed.

3. The image-forming apparatus according to claim 2, wherein the positioning mechanism includes a member provided on an inner side of the first cover, and a member provided on a side of the housing opposed to the inner side of the first cover, such that the members provided on the inner side of the first cover and on the opposed side of the housing engage with each other.

4. The image-forming apparatus according to claim 3, wherein the mutually engaging members of the positioning mechanism include a protrusion and a recess that engage with each other, and the protrusion has an end portion having a cross-section that reduces toward an end.

5. The image-forming apparatus according to claim 4, wherein the end portion of the protrusion has a hemispherical shape.

6. The image-forming apparatus according to claim 1, wherein the positioning mechanism includes a member provided on an inner side of the first cover, and a member provided on a side of the housing opposed to the inner side of the first cover, such that the members provided on the inner side of the first cover and on the opposed side of the housing engage with each other.

7. The image-forming apparatus according to claim 6, wherein the mutually engaging members of the positioning mechanism include a protrusion and a recess that engage with each other, and the protrusion has an end portion having a cross-section that reduces toward an end.

8. The image-forming apparatus according to claim 7, wherein the end portion of the protrusion has a hemispherical shape.

9. The image-forming apparatus according to claim 1, wherein the support member is supported only by the first supporting unit when the first cover is opened, and the support member is supported by the first supporting unit and the second supporting unit when the first cover is closed.

* * * * *